US012036463B1

(12) United States Patent
Mason et al.

(10) Patent No.: US 12,036,463 B1
(45) Date of Patent: Jul. 16, 2024

(54) GOLF TRAINING DEVICE FOR IMPROVED PUTTING TECHNIQUE

(71) Applicant: WhyGolf, LLC, Escondido, CA (US)

(72) Inventors: Bradley R. Mason, Rancho Santa Fe, CA (US); Jeffrey T. Mason, Valley Center, CA (US); Anthony M. Paolucci, Rancho Santa Fe, CA (US)

(73) Assignee: WhyGolf LLC, Escondido, CA (US)

( * ) Notice: Subject to any disclaimer, the term of this patent is extended or adjusted under 35 U.S.C. 154(b) by 0 days.

(21) Appl. No.: 18/385,382

(22) Filed: Oct. 31, 2023

(51) Int. Cl.
*A63B 69/36* (2006.01)

(52) U.S. Cl.
CPC ..... *A63B 69/3676* (2013.01)

(58) Field of Classification Search
CPC ..... A63B 69/3676
See application file for complete search history.

(56) References Cited

U.S. PATENT DOCUMENTS 3,113,780 A * 12/1963 Livingstone ..... A63B 69/3623 473/265
4,368,888 A * 1/1983 Ren ..... A63B 57/40 473/164
4,826,174 A * 5/1989 Hoyt, Jr. ..... A63B 57/357 473/157
6,503,152 B1 * 1/2003 Pelz ..... A63B 63/00 473/157
6,840,870 B1 * 1/2005 Froggatte ..... A63B 24/0003 473/265
6,923,730 B1 * 8/2005 Potter ..... A63B 69/3676 473/265
7,614,961 B2 * 11/2009 Schmutz ..... A63B 24/0003 473/266
D945,548 S * 3/2022 Ruggiero ..... D21/791
2009/0170623 A1 * 7/2009 Christensen ..... A63B 47/00 473/261
2010/0035699 A1 * 2/2010 Sorenson ..... A63B 69/3621 473/278
2013/0178303 A1 * 7/2013 Butler ..... A63B 69/3676 473/265
2020/0129833 A1 * 4/2020 Cooper ..... A63B 69/3676
2022/0088448 A1 * 3/2022 Freuler ..... A63B 57/353
(Continued)

FOREIGN PATENT DOCUMENTS

KR 1168347 B1 * 7/2012 ..... A63B 69/3676
KR 20230161720 A * 5/2022 ..... A63B 69/3676

*Primary Examiner* — Joshua T Kennedy
(74) *Attorney, Agent, or Firm* — CP LAW GROUP PC; Cy Bates

(57) ABSTRACT

A golf training device is provided including a base plate having a putting channel. The device may also include a calibration plate having a calibration channel, a ball gate including first and second ball gate posts and/or a putter gate including first and second putter gate posts. The calibration plate is selectively attachable to the base plate with the calibration channel overlaying the putting channel. The ball gate has an adjustable ball gate width sufficient to allow a standard golf ball to pass therethrough and the putter gate has an adjustable putter gate width sufficient to allow a head of a putter to pass therethrough. The ball and putter gate widths are adjusted by rotating the first and/or second ball gate posts and the first and/or second putter gate posts, respectively.

19 Claims, 8 Drawing Sheets

(56) References Cited

U.S. PATENT DOCUMENTS

| | | | | |
|---|---|---|---|---|
| 2023/0149788 | A1* | 5/2023 | Peterich, II | A63B 69/3676 473/257 |
| 2023/0158389 | A1* | 5/2023 | Lee | A63B 69/3617 473/219 |
| 2023/0201689 | A1* | 6/2023 | Bush, III | A63B 69/3676 473/173 |

* cited by examiner

GOLF TRAINING DEVICE FOR IMPROVED PUTTING TECHNIQUE

FIELD OF THE INVENTION

The present invention relates generally to the sport of golf and more particularly to training devices that are used to improve a golfer's putting technique.

BACKGROUND

Putting is a key element in a golfer's short game. Accordingly, any improvement a golfer can make to his or her putting technique benefits the golfer's short game and correspondingly the golfer's overall game, thereby achieving the ultimate goal of reducing the golfer's score. It is generally recognized that in order to putt successfully a golfer must accurately assess a number of external variables that determine the break of the green before initiating the putt. Among these external environmental variables are the weather conditions at the time of the putt including wind direction and precipitation, the direction of the grain of the grass on the green and the slopes and contours of the green between the lie of the ball and the cup. Assessing these external variables is termed "reading the green."

A golfer uses the read of the green to select a target and corresponding target line for a putt. The target, alternately termed an aim point, is an imaginary point on the green that the golfer aims the ball toward and the target line is an imaginary straight line extending through the ball and target. If the golfer accurately aims the ball toward a correct target and squarely initiates the path of the ball along a correct ball start segment of the target line at the correct speed, the ball should go in the hole. It is noteworthy that the target is oftentimes not the cup itself, but is a point on either side of the cup whose precise location depends on the break of the green. This is because the actual path the ball takes to the cup deviates from the selected target line as the ball travels away from the ball start point toward the cup and encounters the external variables enumerated above.

Once the golfer has read the green and selected a target and target line, the golfer sets up for the putt. For right-handed golfers, setup is initiated by gripping the putter, positioning the feet to the left of the ball and target line (when viewed in the direction of the cup) and addressing the ball, i.e., placing the putter behind the ball with the face of the putter directed toward the backside of the ball. For left-handed golfers, setup is initiated in substantially the same manner except that the golfer positions the feet to the right of the ball and target line. Setup is continued by aiming the putter face at the target while squarely aligning the putter face with the target line, i.e., orienting the putter face at a right angle to the target line. Once the putter face is squarely aligned, the golfer re-adjusts the position of the feet, if necessary, to ensure that the line of the feet is parallel to the target line. The line of the knees, hips and shoulders should likewise align parallel to the target line and the line of the feet. The golfer assumes a correct putting posture by positioning the golfer's head with the eyes facing down directly over or just inside the ball and thereafter turning the head and eyes toward the cup so that the golfer's line of sight runs up and down the target line.

After the golfer is set up in a proper stance for the putt with the putter in hand, the golfer is prepared to stroke the putt. Stroking the putt is the act of swinging the putter back and forth like a pendulum along an arced stroke path that is determined by the height of the golfer's center of rotation, i.e., the base of the back of the golfer's neck. The putting stroke takes the putter head back away from the ball a distance that is a function of the length and desired pace of the putt. The putting stroke then reverses direction, swinging the putter head forward so that the putter face impacts the backside of the ball and propels the ball to the cup. It is important that the golfer maintains the putter face perfectly square to the target line at impact and that the putter head impacts the backside of the ball at the center of the putter face during the putting stroke. In sum, an accurate reading of the green and a proper putt setup and putting stroke are essential to putting the ball in the hole.

The present invention recognizes a need for a golf training device that improves a golfer's putting technique. Accordingly, it is an object of the present invention to provide such a device. It is another object of the present invention to provide a golf training device that enables a golfer to detect errors in the target line for the putt and make corrective adjustments to the target line. It is another object of the present invention to provide a golf training device that facilitates a proper putting set up. It is yet another object of the present invention to provide a golf training device that facilitates a proper putting stroke. These objects and others are accomplished in accordance with the invention described hereafter.

SUMMARY OF THE INVENTION

A golf training device is disclosed herein. The golf training device may be characterized as a base plate and a ball gate. The base plate has a top, a bottom, a front, a rear, a first lateral outer side, a second lateral outer side and a putting channel having an open front at the front of the base plate. The putting channel also preferably has a first lateral inner side, a second lateral inner side and a closed rear. The putting channel preferably extends in a narrowing taper from the open front to the closed rear of the putting channel, thereby providing the putting channel with a substantially V-shape configuration widening as the putting channel approaches the open front of the putting channel. The open front of the putting channel is more proximal to the front of the base plate than to the rear and the closed rear of the putting channel is more proximal to the rear of the base plate than to the front. The ball gate is positioned on the top of the base plate proximal to the front of the base plate. The ball gate has an adjustable ball gate width sufficient to allow a standard golf ball to pass through the ball gate. The ball gate includes a first ball gate post and a second ball gate post and the ball gate width is adjusted by rotating the first and/or second ball gate posts.

In accordance with one embodiment, the golf training device further comprises a first eye alignment mark and a second eye alignment mark formed on the top of the base plate. The first and second eye alignment marks are on opposite sides of the putting channel adjacent to the closed rear of the putting channel and rear portions of the first and second lateral inner sides of the putting channel. In accordance with another embodiment, the golf training device further comprises a putter gate positioned on the top of the base plate proximal to the rear of the base plate. The putter gate has an adjustable putter gate width sufficient to allow a head of a putter to pass through the putter gate. The putter gate includes a first putter gate post and a second putter gate post and the putter gate width is adjusted by rotating the first and/or second putter gate posts. In accordance with yet another embodiment, the golf training device further comprises a friction pad on the top of the base plate behind the putting channel. The friction pad preferably has a longitudinal axis collinear with a longitudinal axis of the base plate and is formed from an elastically deformable high friction material.

The present invention may alternately be characterized as a golf training device including a base plate and a calibration plate. The base plate has a top, a bottom, a front, a rear, and a putting channel having an open front at the front of the base plate. The calibration plate is selectively attachable to the base plate. The calibration plate overlays the putting channel when the calibration plate and base plate are attached to one another. The calibration plate has a calibration channel preferably having a first lateral inner side, a second lateral inner side, an open front and a closed rear.

In accordance with one embodiment of the golf training device as presently characterized, the golf training device further comprises first and second lateral ball guide rails on the calibration plate laterally bounding the calibration channel. The first and second lateral ball guide rails are preferably parallelly aligned with one another and preferably extend adjacent to the first and second lateral inner sides of the calibration channel. In accordance with another embodiment of the golf training device as presently characterized, the golf training device further comprises a putter gate positioned on the top of the base plate proximal to the rear of the base plate. The putter gate has an adjustable putter gate width sufficient to allow a head of a putter to pass through the putter gate. The putter gate includes a first putter gate post and a second putter gate post and the putter gate width is adjusted by rotating the first and/or second putter gate posts.

The present invention may alternately be characterized as a golf training device including a base plate, a calibration plate and a ball gate. The base plate has a top, a bottom, a front, a rear and a putting channel having an open front at the front of the base plate. The putting channel also preferably has a first lateral inner side, a second lateral inner side and a closed rear. The putting channel extends in a narrowing taper from the open front to the closed rear of the putting channel, thereby providing the putting channel with a substantially V-shape configuration widening as the putting channel approaches the closed front of the putting channel.

The calibration plate is selectively attachable to the base plate. The calibration plate overlays the putting channel when the calibration plate and the base plate are attached to one another. The calibration plate has a calibration channel. The ball gate is positioned on the base plate proximal to the front of the base plate. The ball gate has an adjustable ball gate width sufficient to allow a standard golf ball to pass through the ball gate. The ball gate includes a first ball gate post and a second ball gate post and the ball gate width is adjusted by rotating the first and/or second ball gate posts.

In accordance with one embodiment of the golf training device as presently characterized, the golf training device further comprises a putter gate positioned on the top of the base plate proximal to the rear of the base plate. The putter gate has an adjustable putter gate width sufficient to allow a head of a putter to pass through the putter gate. The putter gate includes a first putter gate post and a second putter gate post and the putter gate width is adjusted by rotating the first and/or second putter gate posts. In accordance with another embodiment of the golf training device as presently characterized, the golf training device further comprises a friction pad on the top of the base plate behind the putting channel formed from an elastically deformable high friction material. In accordance with yet another embodiment of the golf training device as presently characterized, the golf training device further comprises a first eye alignment mark and a second eye alignment mark formed on the top of the base plate. The first and second eye alignment marks are on opposite sides of the putting channel adjacent to the closed rear of the putting channel and rear portions of the first and second lateral inner sides of the putting channel. In accordance with still another embodiment of the golf training device as presently characterized, the golf training device further comprises first and second lateral ball guide rails on the calibration plate laterally bounding the calibration channel.

The present invention may alternately be characterized as a golf training device including a base plate and a friction pad. The base plate has a top, a bottom, a front, a rear and a putting channel between the front and rear of the base plate. The putting channel has an open front at the front of the base plate and the friction pad is positioned on the top of the base plate behind the putting channel.

BRIEF DESCRIPTION OF THE DRAWINGS

The below-listed drawing figures illustrate one or more embodiments of the present invention by way of example and not by way of limitation. Common reference characters are used among the different drawing figures to indicate the same structural elements.

DETAILED DESCRIPTION OF THE INVENTION

Figure 1:
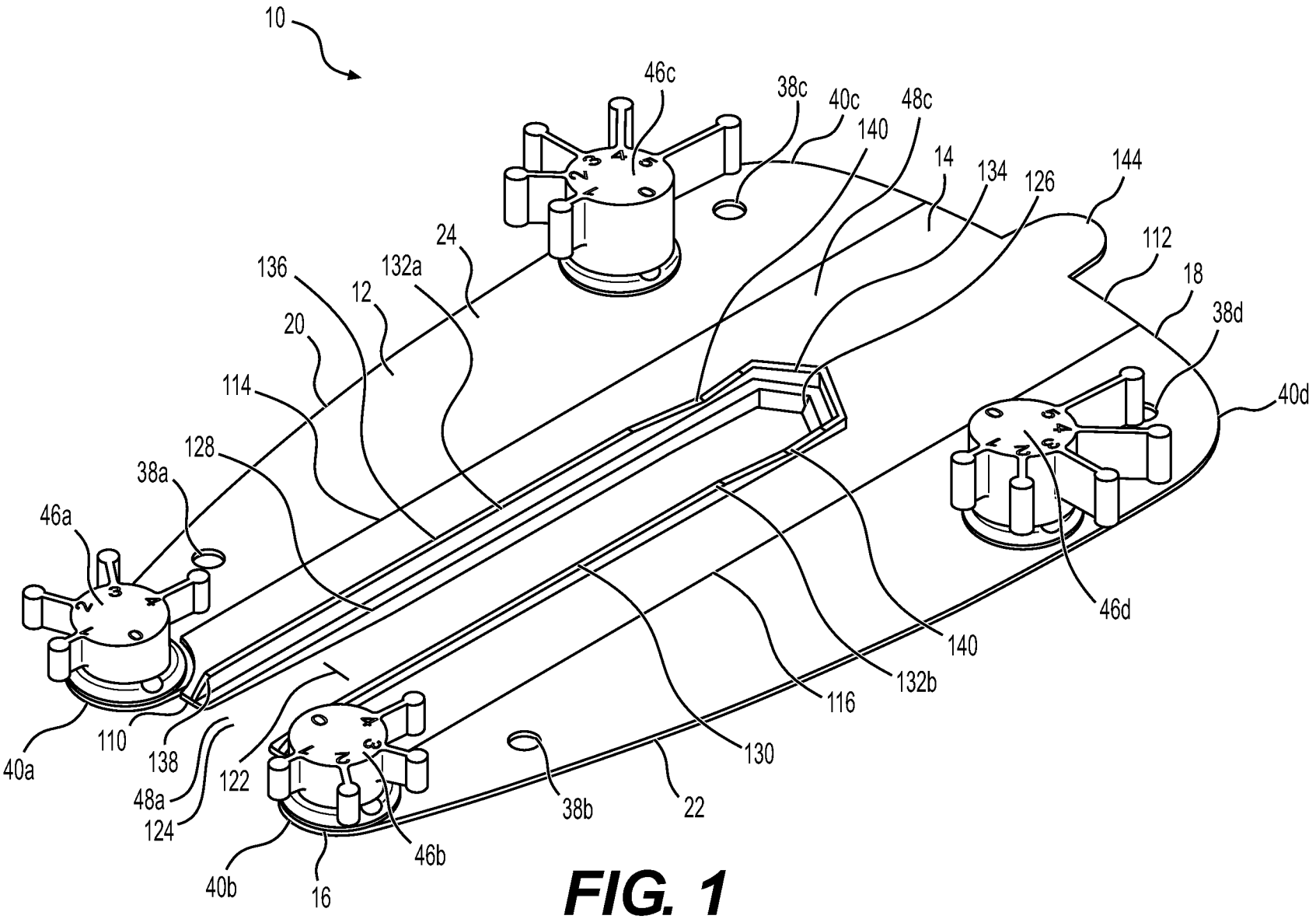
FIG. 1 is a front perspective view of a golf training device that is in a calibration configuration.
Figure 2:
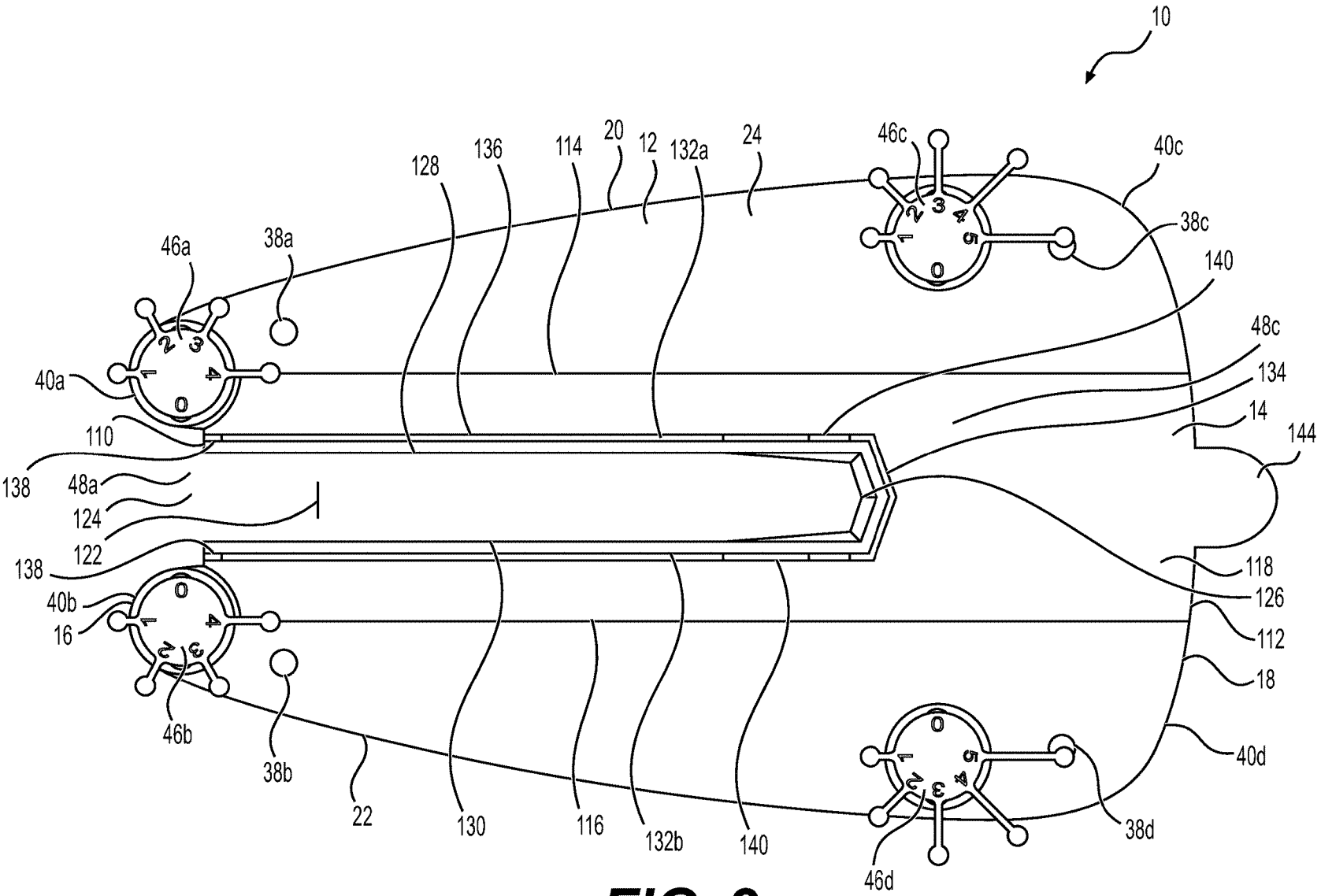
FIG. 2 is a top plan view of the golf training device in the calibration configuration shown in FIG. 1.

An embodiment of a golf training device generally designated 10 in FIGS. 1-4 has two configurations, wherein each configuration accommodates an alternate mode of use. The first configuration of the golf training device 10 is a calibration configuration shown in FIGS. 1-3 that accommodates a calibration mode of use and the second configuration is a putting configuration shown in FIG. 4 that accommodates a putting mode of use. The calibration configuration comprises a base plate 12 and a calibration plate 14 overlaying the base plate in close fitting engagement therewith. The putting configuration also comprises the base plate 12, but excludes the calibration plate 14.

The base plate 12 is a unitary structure preferably fabricated from a relatively thin, but rigid and sturdy sheet metal. The base plate 12 has an essentially four-sided planar configuration with a front 16, a rear 18, a first lateral outer side 20, a second lateral outer side 22, a top 24 and a bottom 26. The front 16 is opposite the rear 18 and is positioned more proximal to the putting target and faces toward it during use. The rear 18 is correspondingly positioned more distal from the putting target and faces away from it during use. The first and second lateral outer sides 20, 22 extend between the front and rear 16, 18 and are opposite one another. The first and second lateral outer sides 20, 22 are equal in length and are substantially longer than the front or rear 16, 18 of the base plate 12. Consequently, the base plate 12 has an elongate configuration with a longitudinal axis having a horizontal orientation during use of the golf training device 10. The front 16 is preferably narrower than the rear 18 such that the first and second lateral outer sides 20, 22 have a slight arcuate taper that narrows in the direction of the front 16. An exemplary base plate 12 has a substantially uniform length of about 12 inches, a front width of about 4 inches, a rear width of about 7 inches and a substantially uniform thickness of about 0.063 inches.

The terms "top" and "bottom" and the corresponding terms "upper" and "lower" are used herein to describe the position of certain elements of the golf training device 10 relative to the putting surface that supports the golf training device 10 during use. A "bottom" or "lower" element of the golf training device 10 is closer to the putting surface than a "top" or "upper" element. Conversely, a "top" or "upper" element of the golf training device 10 is further from the putting surface than a "bottom" or "lower" element. The terms "inner" and "outer" are used herein to describe the position of certain elements of the golf training device 10 relative to the longitudinal axis of the golf training device 10. An "inner" element is closer to the longitudinal axis of the golf training device 10 than an "outer" element. Conversely, an "outer" element is further from the longitudinal axis of the golf training device 10 than an "inner" element.

The interior of the base plate 12 is partially cutout, thereby forming a four-sided putting channel 28 having a longitudinal axis collinear with the longitudinal axis of the base plate 12. The putting channel 28 has an open front 30 positioned at the front 16 of the base plate 12 and a closed rear 32 positioned within the interior of the base plate 12 so that the putting channel 28 extends rearward about ⅔ the length of the base plate 12. An exemplary putting channel 28 has a length of about 8.5 inches. The putting channel 28 is laterally bounded by a first lateral inner side 34 and a second lateral inner side 36 that extend in a slight narrowing taper from the open front 30 to the closed rear 32 of the putting channel 28. As such, the putting channel 28 has a substantially V-shape configuration that widens as the putting channel 28 approaches the open front 30. An exemplary width of the putting channel 28 at its closed rear 32 is about 0.875 inches and an exemplary width of the putting channel 28 at its open front 30 is about 1.75 inches.

First and second front anchoring apertures 38*a*, 38*b* and first and second rear anchoring apertures 38*c*, 38*d* are provided in the base plate 12 that are identically sized and configured relative to one another. The first front anchoring aperture 38*a* is proximal to a first front corner 40*a* of the base plate 12, the second front anchoring aperture 38*b* is proximal to a second front corner 40*b*, the first rear anchoring aperture 38*c* is proximal to a first rear corner 40*c* and the second rear anchoring aperture 38*d* is proximal to a second rear corner 40*d*. Each anchoring aperture 38*a*, 38*b*, 38*c*, 38*d* extends through the entire thickness of the base plate 12 and has a relatively small diameter that is slightly larger than the diameter of the elongated stem of a standard golf tee.

First and second ball gate mounting apertures 42*a*, 42*b* and first and second putter gate mounting apertures 42*c*, 42*d* are also provided in the base plate 12 that are identically sized and configured relative to one another. The first ball gate mounting aperture 42*a* is adjacent to the first front anchoring aperture 38*a* and is likewise proximal to the first front corner 40*a*. The second ball gate mounting aperture 42*b* is adjacent to the second front anchoring aperture 38*b* and is likewise proximal to the second front corner 40*b*. The first putter gate mounting aperture 42*c* is adjacent to the first rear anchoring aperture 38*c* and is likewise proximal to the first rear corner 40*c*. The second putter gate mounting aperture 42*d* is adjacent to the second rear anchoring aperture 38*d* and is likewise proximal to the second rear corner 40*d*. Each gate mounting aperture 42*a*, 42*b*, 42*c*, 42*d* extends through the entire thickness of the base plate 12.

Figure 3:
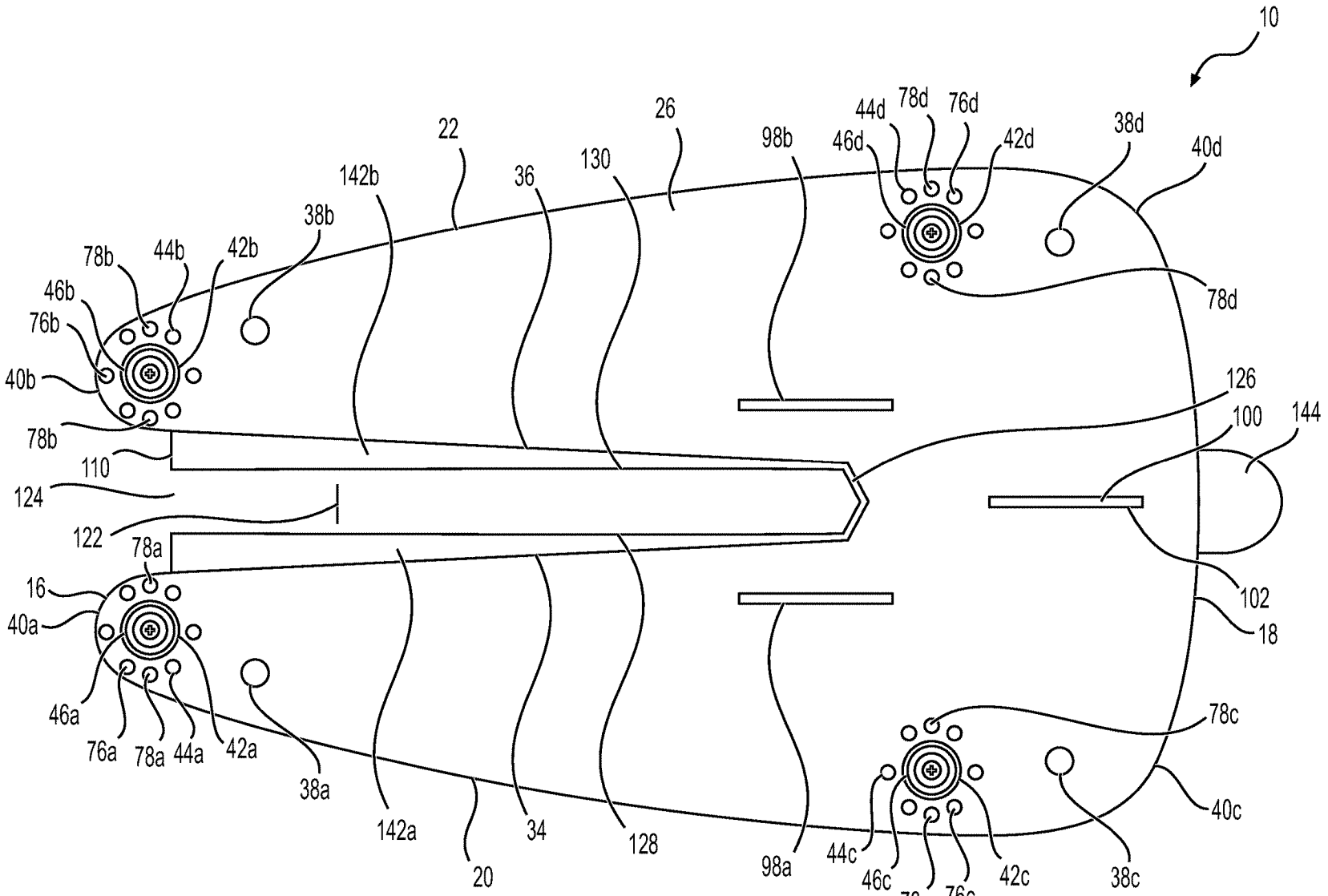
FIG. 3 is a bottom plan view of the golf training device in the calibration configuration shown in FIG. 1
Figure 4:
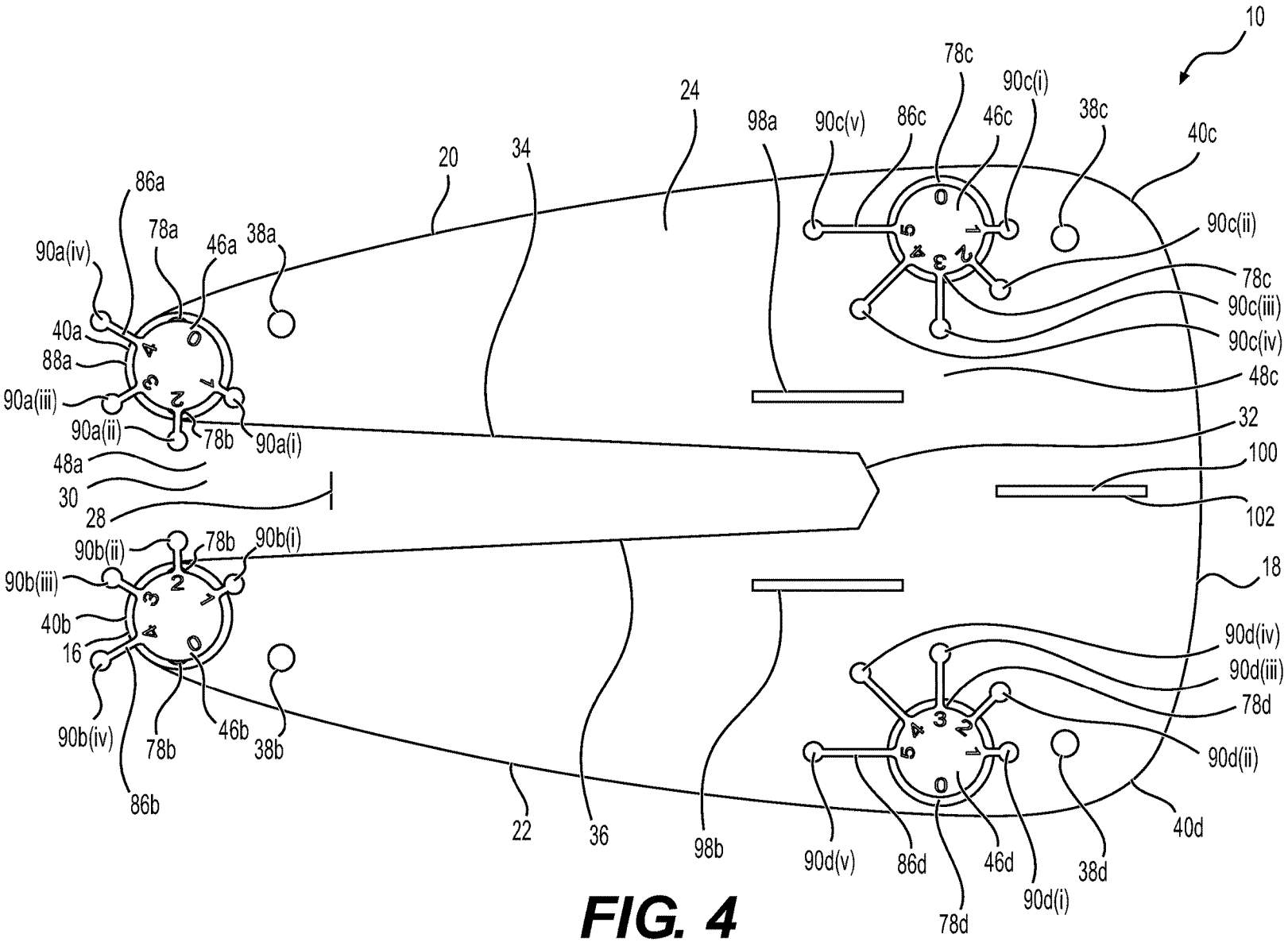
FIG. 4 is a top plan view of the golf training device in a putting configuration.

With specific reference to FIG. 3, a plurality of first ball gate holes 44*a* encircle the first ball gate mounting aperture 42*a*, a plurality of second ball gate holes 44*b* encircle the second ball gate mounting aperture 42*b*, a plurality of first putter gate holes 44*c* encircle the first putter gate mounting aperture 42*c* and a plurality of second putter gate holes 44*d* encircle the second putter gate mounting aperture 42*d*. All of the gate holes 44*a*, 44*b*, 44*c*, 44*d* are preferably identically sized and configured. To reduce drawing clutter in FIG. 3, only one gate hole 44*a*, 44*b*, 44*c*, 44*d* encircling its respective gate mounting aperture 42*a*, 42*b*, 42*c*, 42*d* is labeled with a reference number since the remaining gate holes are readily apparent without any additional labeling.

In accordance with the present embodiment, the golf training device 10 further comprises a ball gate that includes a first ball gate post 46*a*, a second ball gate post 46*b* and a ball gate opening 48*a*. The ball gate opening 48*a* horizontally extends between the first and second ball gate posts 46*a*, 46*b*. The first and second ball gate posts 46*a*, 46*b* are identically sized and configured relative to one another so details of the first and second ball gate posts 46*a*, 46*b* are described hereafter with sole reference to the first ball gate post 46*a*. However, it is understood that this description applies equally to the identical second ball gate post 46*b*. An "a" is appended to the reference numbers that are assigned to respective elements of the first ball gate post 46*a*. Elements of the second ball gate post 46*b* shown in the drawings that are structurally identical to those of the first ball gate post 46*a* are assigned the same reference number as those of the first ball gate post 46*a*, but a "b" rather than an "a" is appended to the reference number.

Figure 5:
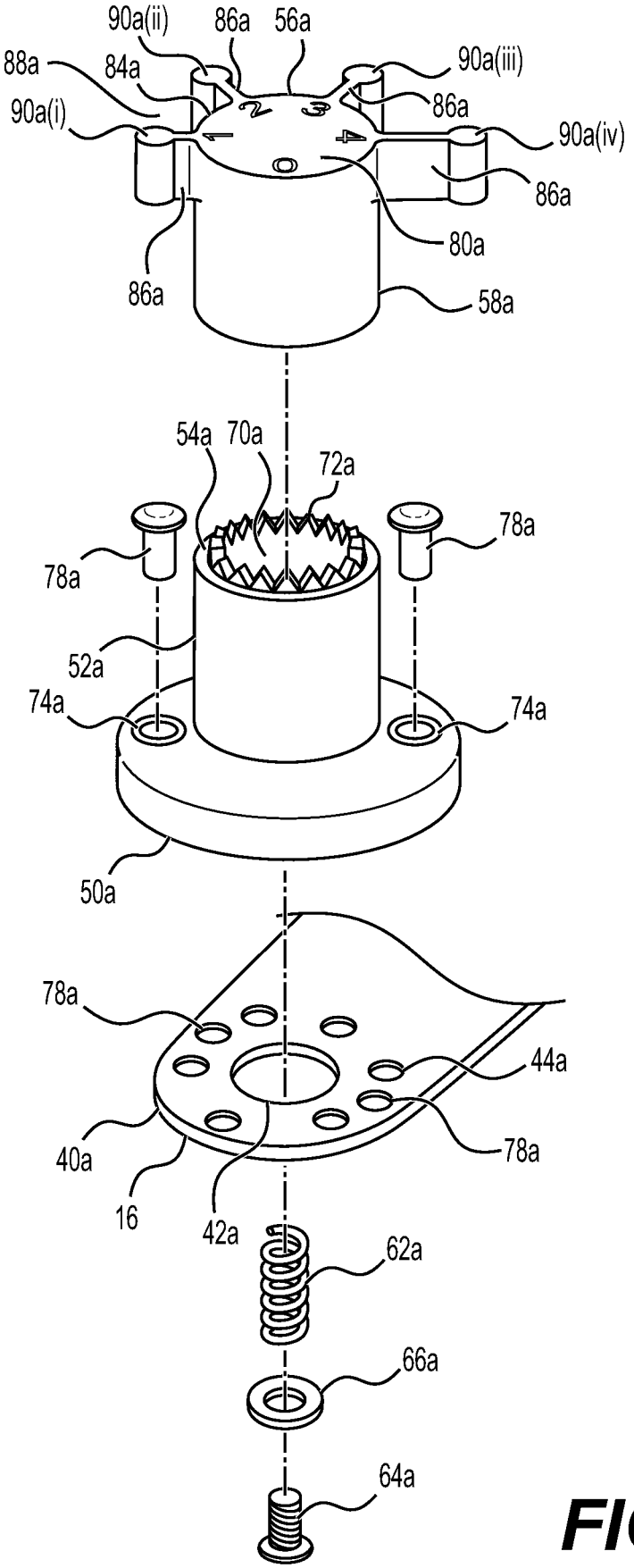
FIG. 5 is an exploded view of a ball gate post used in the golf training device.
Figure 6:
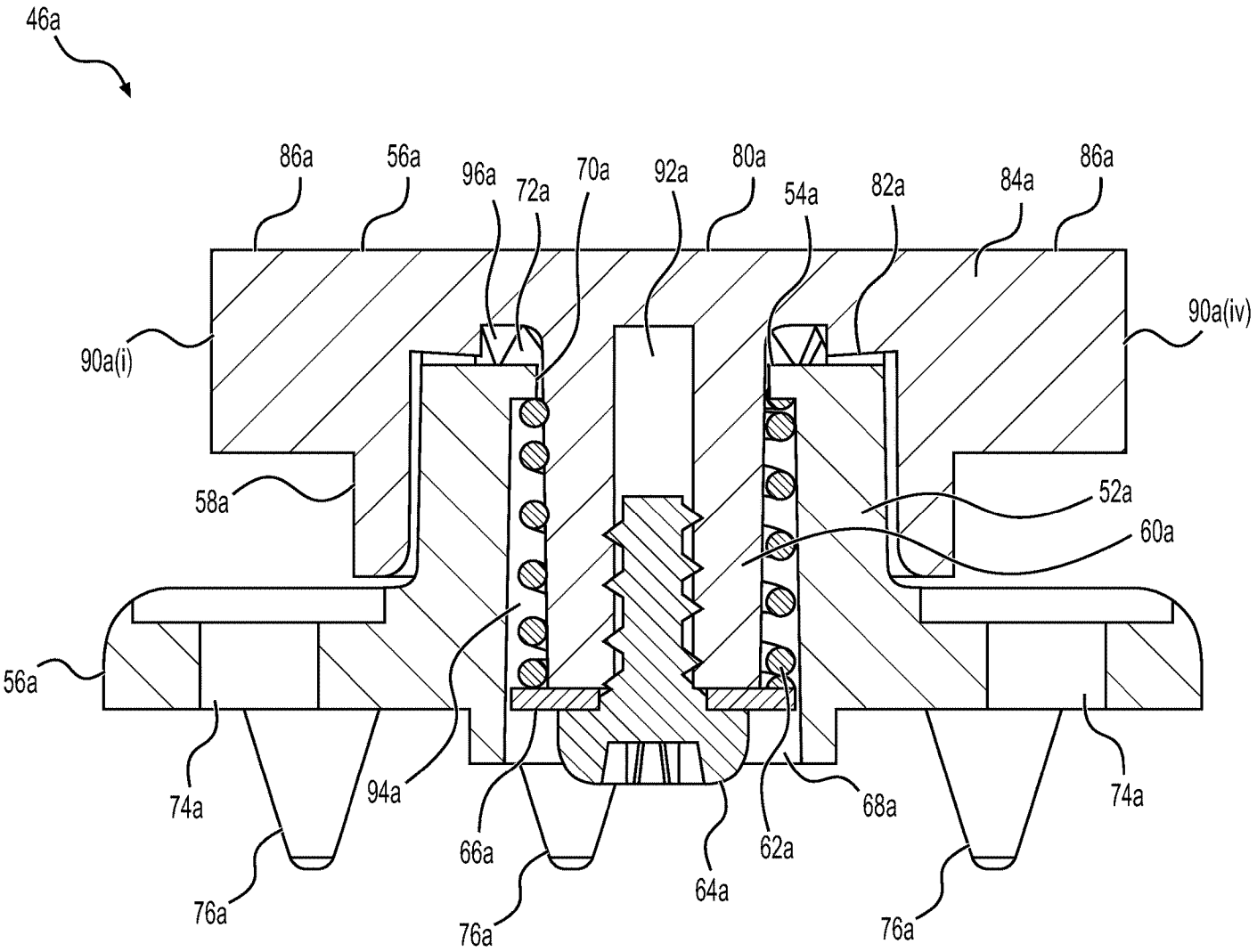
FIG. 6 is an elevation section of the ball gate post shown in FIG. 5.

With additional reference to FIGS. 5 and 6, the first ball gate post 46*a* has a first ball gate base 50*a*, a first ball gate column 52*a*, a first ball gate retention plate 54*a*, a first ball gate head 56*a*, a first ball gate sleeve 58*a* and a first ball gate retention post 60*a*, all of which are preferably constructed from a sturdy rigid plastic. The first ball gate base 50*a* has a disk-like configuration, the first ball gate column 52*a* has a hollow cylindrical configuration and the first ball gate retention plate 54*a* has a circular planar configuration. The first ball gate base 50*a* and retention plate 52*a*, 54*a* each has top and bottom faces and the first ball gate column has top and bottom ends. The first ball gate base, column and retention plate 50*a*, 52*a*, 54*a* are preferably constructed as a single integrated structure termed a bottom post assembly. The top and bottom ends of the first ball gate column 52*a* are open. The first ball gate base 50*a* and bottom end of the first ball gate column 52*a* are integrally formed together as one at their points of the intersection and the lateral side of the first ball gate retention plate 54*a* and interior wall of the first ball gate column 52*a* are integrally formed together as one along their line of intersection.

The first ball gate head 56*a* has a solid cylindrical configuration while the first ball gate sleeve and retention post 58*a*, 60*a* each has a hollow cylindrical configuration and top and bottom ends. The first ball gate head, sleeve and retention post 56*a*, 58*a*, 60*a* are preferably constructed as a single integrated structure termed a top post assembly that is separate and distinct from the bottom post assembly. The first ball gate head 56*a* and top end of the first ball gate sleeve 58*a* are integrally formed together as one along their circular line of the intersection. The first ball gate head 56*a* and top end of the first ball gate post 60*a* are similarly integrally formed together as one along their circular line of the intersection. When the first ball gate post 46*a* is in use, the longitudinal axes of the first ball gate base, retention plate and head 50*a*, 54*a*, 56*a* are all horizontally aligned and the longitudinal axes of the first ball gate column, sleeve and retention post 52*a*, 58*a*, 60*a* are all vertically aligned. The first ball gate post 46*a* additionally includes a first ball gate resistance member 62*a* and a first ball gate fastener 64*a*, each having top and bottom ends. The first ball gate post 46*a* may also include a first ball gate washer 66*a* associated with the first ball gate fastener 64*a*.

Referring to the bottom post assembly, the first ball gate column 52*a* extends upward and downward from its intersection with the first ball gate base 50*a*. The first ball gate base 50*a* has a base opening 68*a* through its center and the first ball gate column 52*a* extends through the base opening 68*a*. The first ball gate base 50*a*, first ball gate column 52*a* and base opening 68*a* are all concentric with one another. The interior cylindrical wall of the first ball gate column 52*a* defines a smooth continuous interior passageway. The first ball gate retention plate 54*a* is horizontally disposed across interior passageway at the top end of the first ball gate column 52*a*. A plate opening 70*a* extends through the center of the first ball gate retention plate 54*a* that is concentric with the first ball gate column 52*a* and base opening 68*a*. However, the diameter of the plate opening 70*a* is smaller than that of the first ball gate column 52*a* and base opening 68*a*. A plurality of teeth defining a lower teeth ring 72*a* are formed on the top end of the first ball gate column 52*a* and the top face of the first ball gate retention plate 54*a*.

The first ball gate base 50*a* is wider than the first ball gate column 52*a* and extends horizontally beyond the circumference of the first ball gate column 52*a*. A pair of base plate fastener openings 74*a* extend through the first ball gate base 50*a* and a plurality of downward-extending conically-shaped nubbins 76*a* are positioned around the circumference of the bottom face of the first ball gate base 50*a*. Fixable attachment of the bottom post assembly to the base plate 12 is initiated by concentrically aligning the base opening 68*a* and first ball gate column 52*a* with the first ball gate mounting aperture 42*a* and simultaneously aligning the pair of base plate fastener openings 74*a* in the first ball gate base 50*a* with two of the first ball gate holes 44*a*. The nubbins 76*a* are aligned with the remaining first ball gate holes 44*a* causing the aligned nubbins 76*a* to extend through the remaining first ball gate holes 44*a* and away from the bottom 26 of the base plate 12. The extending bottom ends of the nubbins 76*a* form a localized roughened surface on the bottom 26 of the base plate 12. To reduce clutter in the drawings, only limited number of nubbins are labeled with reference numbers since the remaining nubbins are readily apparent to one of ordinary skill in the art without any labeling. Fixable attachment of the bottom post assembly to the base plate 12 is completed by extending base plate fasteners 78*a* such as rivets through the pair of base plate fastener openings 74*a* and two aligned first ball gate holes 44*a* and securing the base plate fasteners 78*a* therein.

Referring to the top post assembly, the first ball gate head 56*a* has a substantially planar horizontally-oriented external top face 80*a*, a substantially planar horizontally-oriented internal bottom face 82*a* and a vertically-oriented lateral face 84*a* extending between the top and bottom faces 80*a*, 82*a* of the first ball gate head 56*a*. The lateral face 84*a* has a plurality of horizontally-oriented first ball gate projections 86*a* disposed around it, each of which is circumferentially separated from the adjacent first ball gate projection(s) 86*a* by an interstice 88*a*. Each first ball gate projection 86*a* has a proximal fixed end that is integral with the lateral surface of the first ball gate head 56*a* and a distal free end, termed a first ball gate limit 90*a* that extends horizontally away therefrom. The terms "proximal" and "distal" are used in this instance to denote the relative distances of given elements to the lateral surface of the first ball gate head 56*a*. Each first ball gate projection 86*a* is characterized by its radial distance away from an axis of rotation of the first ball gate head 56*a*. This radial distance of each first ball gate projection 86*a* is different than those of the other first ball gate projections 86*a*.

The first ball gate head 56*a* of the present embodiment has, by way of example, four first ball gate limits 90*a*(*i*), 90*a*(*ii*), 90*a*(*iii*), 90*a*(*iv*) serially positioned around its lateral face 84*a*. Reference markings (e.g., 1-4) may be provided on the top face 80*a* that are aligned with each of the first ball gate limits 90*a*(*i*), 90*a*(*ii*), 90*a*(*iii*), 90*a*(*iv*), thereby enabling the user to more easily identify the first ball gate limits and differentiate them from one another. Another reference marking (e.g., 0) may also be provided on the top face 80*a*. The 0 reference marking is aligned with a segment of the lateral face 84*a* that does not have a first ball gate projection 86*a* extending therefrom. This segment of the lateral face 84*a* is a closer radial distance to the axis of rotation of the first ball gate head 56*a* than any of the first ball gate projections 86*a*. In any case, the first ball gate head of the present invention is not limited to any specific number of ball gate projections and first ball gate limits.

The first ball gate retention post 60*a* has an open cylindrical interior 92*a* that extends upward to the bottom face 82*a* of the first ball gate head 56*a*. The top end of the first ball gate retention post 60*a* as well as the top end of the first ball gate sleeve 58*a* intersect the bottom face 82*a* of the first ball gate head 56*a*. The outside diameter of the first ball gate retention post 60*a* is smaller than the diameter of the retention plate opening 70*a* as well as the inside diameter of the first ball gate sleeve 58*a*. The first ball gate retention post 60*a* extends through the retention plate opening 70*a* and resides within the interior of the first ball gate sleeve 58*a*. The difference between the outside diameter of the first ball gate retention post 60*a* and the inside diameter of the first ball gate sleeve 58*a* is sufficient to form a first ball gate annulus 94*a* between the inside wall of the first ball gate column 52*a* and outside the wall of the first ball gate retention post 60*a* which are parallel to one another. A plurality of teeth defining an upper teeth ring 96*a* are formed on the bottom face 82*a* of the first ball gate head 56*a* and are positioned above and adjacent to the lower teeth ring 72*a*.

The first ball gate sleeve 58*a* has an inside diameter larger than the outside diameter of the first ball gate column 52*a* so that the bottom end of the first ball gate sleeve 58*a* fits over the top end of the first ball gate column 52*a*. The bottom end of the first ball gate sleeve 58*a* extends downardly along the outer wall of the first ball gate column 52*a* toward the top face of the first ball gate base 50*a* while the top end of the first ball gate column 52*a* extends upward toward the bottom face 82*a* of the first ball gate head 58*a*. As a result, the inside wall of the first ball gate sleeve 58*a* slidably engages the outside wall of the first ball gate column 52*a*, thereby enabling rotatable attachment of the top post assembly to the bottom post assembly.

The first ball gate resistance member 62*a* is preferably a coiled extension spring resistant to expansion. The inside diameter of the first ball gate resistance member 62*a* is larger than the diameter of the retention plate opening 70*a* and the outside diameter of the first ball gate retention post 60*a*. As a result, the top end of the first ball gate resistance member 62*a* abuts against the bottom face of the first ball gate retention plate 54*a* and the first ball gate resistance member 62*a* extends downward through the first ball gate annulus 94*a* until the bottom end of the first ball gate resistance member 62*a* is even with the bottom end of the first ball gate retention post 60*a*. The bottom end of the first ball gate resistance member 62*a* abuts against the first ball gate washer 66*a* that is positioned above the head of the first ball gate fastener 64*a*. Alternatively, the first ball gate washer 66*a* can be omitted if the diameter of the head of the first ball gate fastener 64*a* is sufficiently large. In this case, the bottom end of the first ball gate resistance member 62*a* abuts against the top face of the head of the first ball gate fastener 64*a*.

The first ball gate fastener 64*a* is preferably a screw whose top end passes through the opening of the first ball gate washer 66*a*, if present, and extends upward into fastener retention opening 92*a*. The first ball gate fastener 64*a* is securely threaded in the fastener retention opening 92*a*, thereby securing the first ball gate resistance member 62*a* in place within the first ball gate annulus 94*a*. The expansion resistance force of the first ball gate resistance member 62*a* causes the lower teeth ring 72*a* on the top end of the first ball gate column 52*a* and the upper teeth ring 96*a* on the bottom face 82*a* of the first ball gate head 56*a* to engage and mesh with one another as a result of their corresponding size and spacing.

The top post assembly is rotatable relative to the bottom post assembly by manually applying a rotational force to the first ball gate head 56*a*, thereby vertically displacing the top post assembly upward away from the bottom post assembly and unlocking the lower and upper teeth rings 72*a*, 96*a* from one another. The first ball gate head 56*a* is simultaneously rotationally displaced about its axis of rotation until the first ball gate head 56*a* reaches a new position corresponding to alignment of a desired first ball gate limit 90*a* with the ball gate opening 48*a*. Once the new position is attained, the manual rotational force is withdrawn from the first ball gate head 56*a* and the lower and upper teeth rings 72*a*, 96*a* re-align with one another to releasably lock the first ball gate head 56*a* in its new position, wherein the desired first ball gate limit 90*a* is aligned with the ball gate opening 48*a*.

The second ball gate head 56*b* has second ball gate projections 86*b* and second ball gate limits 90*b* that are configured, sized and positioned identically to those 86*a*, 90*a* on the first ball gate head 56*a*. To reduce drawing clutter, only a limited number of second ball gate projections and limits are labeled with reference numbers in the drawings since the remaining second ball gate projections and limits are readily apparent to one of ordinary skill in the art without any labeling. In any case, the second ball gate head 56*b* has four second ball gate limits 90*b* corresponding to the first ball gate limits 90*a*(*i*), 90*a*(*ii*), 90*a*(*iii*), 90*a*(*iv*) on the first ball gate head 56*a*.

During use of the golf training device 10, a selected first ball gate limit 90*a* is positioned at and bounds one side of the ball gate opening 48*a* and a selected second ball gate limit 90*b* is positioned at and bounds the opposite side of the ball gate opening 48*a* from the selected first ball gate limit 90*a*. In most cases first and second ball gate limits 90*a*, 90*b* are selected that are each the same radial distance away from the axis of rotation of their respective first and second ball gate heads 56*a*, 56*b* so that the longitudinal axis of the putting channel 28 bisects the ball gate opening 48*a*. When a first ball gate limit 90*a* is paired with its corresponding mirror-image second ball gate limit 90*b* in the above manner to bookend the ball gate opening 48*a*, this mirror-image pairing is termed a matched first and second ball gate limit pairing, e.g., 90*a*(*i*) and 90*b*(*i*) or 90*a*(*ii*) and 90*b*(*ii*), etc. It is alternatively within the scope of the present invention to pair first and second ball gate limits 90*a*, 90*b* with one another that are not mirror-images. These pairings are termed unmatched first and second ball gate limit pairings, e.g., 90*a*(*i*) and 90*b*(*ii*) or 90*a*(*ii*) and 90*b*(*iii*), etc.

The expanse between the selected first and second ball gate limits 90*a*, 90*b* precisely defines the bounds of the ball gate opening 48*a* and the distance of this expanse is termed a ball gate width. Each first and second ball gate limit 90*a*, 90*b* pairing defines a different ball gate width. It is noted that the greater the radial distance that the first and second ball gate limits 90*a*, 90*b* extend from the axis of rotation of their respective first and second ball gate heads 56*a*, 56*b*, the shorter the ball gate width. Conversely, the shorter the radial distance that the first and second ball gate limits 90*a*, 90*b* extend from the axis of rotation of their respective first and second ball gate heads 56*a*, 56*b*, the greater the ball gate width. Thus, the ball gate width is adjusted by careful selection of the first and second ball gate limit pairing that bookends the ball gate opening 48*a*. In any case, the ball gate width is selected with reference to the dimensions of a standard golf ball which is a sphere having a diameter of 1.68 inches and a geometric center point through which the perpendicular horizontal and vertical axes of the golf ball pass. An exemplary ball gate width is in a range of about 1.75 inches to 2.25 inches. It is noted that the ball gate width can be less than the diameter of a standard golf ball while still allowing the golf ball to pass through the ball gate opening 48*a* because the first and second ball gate heads 56*a*, 56*b* and corresponding first and second ball gate limits 90*a*, 90*b* are often mounted on the base plate 12 at a vertical height below the geometric center point of the golf ball.

In accordance with the present embodiment, the golf training device 10 further comprises a putter gate having a construction substantially the same as that of the ball gate. Accordingly, the putter gate includes a first putter gate post 46*c*, a second putter gate post 46*d* and a putter gate opening 48*c* positioned between the first and second putter gate posts 46*c*, 46*d*. The first and second putter gate posts 46*c*, 46 are identically sized and configured relative to one another and as such are mirror images of one another. The bottom post assembly of the first putter gate post 46*c* is fixably attached to the base plate 12 at the first putter gate mounting aperture 42*c* and the bottom post assembly of the second putter gate post 46*d* is fixably attached to the base plate 12 at the second putter gate mounting aperture 42*d* in substantially the same manner as described above with respect to the bottom post assemblies of the first and second ball gate posts 46*a*, 46*b*. Although the first and second putter gate posts 46*c*, 46*d* dimensionally differ to some extent from the first and second ball gate posts 46*a*, 46*b*, the first and second putter gate posts 46*c*, 46*d* have substantially the same elements and construction as the first and second ball gate posts 46*a*, 46*b*. Accordingly, a "c" and a "d" are appended to the reference numbers assigned to respective elements of the first and second putter gate posts 46*c*, 46*d* that are identical to those of the first and second ball gate posts 46*a*, 46*b*.

Each putter gate post 46*c*, 46*d* has a first and second putter gate base 50*c*, 50*d*, a first and second putter gate column 52*c*, 52*d*, a first and second putter gate head 56*c*, 56*d* and a first and second putter gate sleeve 58*c*, 58*d*, respectively. The first and second putter gate posts 46*c*, 46*d* are assembled in substantially the same manner as described above with respect to the first and second ball gate posts 46*a*, 46*b*. The first and second putter gate heads 56*c*, 56*d* have first and second putter gate projections 86*c*, 86*d* and first and second putter gate limits 90*c*, 90*d* that are configured in a similar manner to those on the first and second ball gate heads 56*a*, 56*b*. However, in the present case the first and second putter gate heads 56*c*, 56*d* have more limits 90*c* than the first and second ball gate heads 56*a*, 56*b* have.

Whereas the first and second ball gate heads 56*a*, 56*b* shown in the drawings each has only four ball gate projections and corresponding ball gate limits, the first and second putter gate heads 56*c*, 56*d* each has five putter gate projections and putter gate limits. Thus, the first putter gate head 56*c* has first putter gate limits 90*c*(*i*), 90*c*(*ii*), 90*c*(*iii*), 90*c*(*iv*), 90*c*(*v*), and the second putter gate head 56*d* has second putter gate limits 90*d*(*i*), 90*d*(*ii*), 90*d*(*iii*), 90*d*(*iv*), 90*d*(*v*). To reduce clutter in the drawings, only a limited number of first and second putter gate projections and limits are labeled with reference numbers since the remaining first and second putter gate projections and limits are readily apparent to one of ordinary skill in the art without any labeling.

During use of the golf training device 10, a selected first putter gate limit 90*c* is positioned at and bounds one side of the putter gate opening 48*c* and a selected second putter gate limit 90*d* is positioned at and bounds the opposite side of the putter gate opening 48*c*. The putter gate limits 90*c*, 90*d* are paired in substantially the same manner as described above with respect to the first and second ball gate limits 90*a*, 90*b* and the putter gate width is adjusted by careful selection of first and second putter gate limits 90*c*, 90*d* at the bounds of the putter gate opening 48*c*. As with the first and second ball gate limits 90*a*, 90*b* of the first and second ball gates, the first and second putter gate limits 90*c*, 90*d* may be selected as mirror-image matched first and second putter gate pairings, e.g., 90*c*(*i*) and 90*d*(*i*) or 90*c*(*ii*) and 90*d*(*ii*), etc. Alternatively, first and second putter gate limits 90*c*, 90*d* may be paired with one another as unmatched pairings that are not mirror-images of one another, e.g., 90*a*(*i*) and 90*b*(*ii*) or 90*a*(*ii*) and 90*b*(*iii*), etc. Unmatched pairings have particular utility when the desired ball striking point on the head of the putter being used is not centered between the ends of the putter head. In any case, the putter gate width is selected with reference to the typical range of putter head widths. An exemplary putter gate width is in a range of about 4 inches to 5.25 inches.

Figure 7:
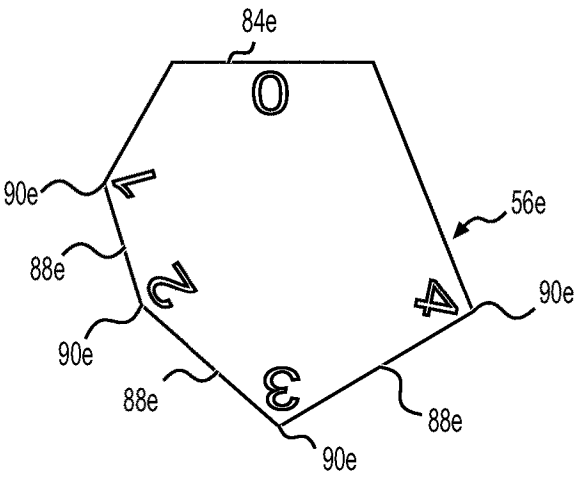
FIG. 7 is a top plan view of an alternate embodiment of a ball gate head used in the golf training device.

In accordance with another embodiment of the present invention, the heads of the ball gates and putter gates are modified as described below. Although this description refers solely to a modified first ball gate head 56*e* shown in FIG. 7, it is understood that this description applies equally to a modified second ball gate head and modified first and second putter gate heads. In the present embodiment, the first ball gate head 56*a* is modified by eliminating the interstices 88*a* between adjacent first ball gate projections 86*a* and filling them in with additional material of construction. As a result, the modified first ball gate head 56*e* has a block-like configuration with a vertically-oriented irregular lateral face 84*e*. The lateral face 84*e* is divided into a plurality of first ball gate facets 88*e* that intersect one another at vertical line segments of intersection. These vertical line segments of intersection are first ball gate limits 90*e* and each is characterized by a specific angle of intersection that is different from that of the other first ball gate limits 90*e*. Since each first ball gate limit 90*e* is positioned a different radial distance away from the central axis of rotation of the modified first ball gate head 56*e* than the other first ball gate limits 90*e*, the first ball gate limits 90*e* of the present embodiment are selected and function in substantially the same manner as the first and second ball and putter gate limits 90*a*, 90*b*, 90*c*, 90*d* described above.

The golf training device 10 further comprises a first eye alignment mark 98*a* and a second eye alignment mark 98*b*, each of which is preferably a line segment, is more preferably a straight line segment and is less preferably an arcuate line segment. The positioned on the top 24 of the base plate 12 equidistant from the longitudinal axis of the putting channel 28. The first eye alignment mark 98*a* resides between the first lateral inner side 34 of the putting channel 28 and the first lateral outer side 20 of the base plate 12 and the second eye alignment mark 98*b* resides between the second lateral inner side 36 and the second lateral outer side 22. The first and second eye alignment marks 98*a*, 98*b* are on opposite sides of the putting channel 28 from one another and are adjacent to the closed rear 32 of the putting channel 28 as well as to the rear portions of the first and second lateral inner sides 34, 36 of the putting channel 28. The first and second eye alignment marks 98*a*, 98*b* are preferably formed by cutting a pair of slits through the base plate 12. However, it is alternately within the scope of the present invention to provide the first and second eye alignment marks 98*a*, 98*b* on the top 24 of the base plate 12 by simply drawing or etching a line thereon.

The golf training device 10 still further comprises a friction pad 100 positioned on the top 24 of the base plate 12 immediately behind the closed rear 32 of the putting channel 28. The friction pad 100 preferably has the configuration of a straight line segment and has a longitudinal axis that is collinear with the longitudinal axes of the base plate 12 and putting channel 28. The friction pad 100 is preferably formed from an elastically deformable high friction material such as rubber or a similar elastomeric material. The friction pad 100 is preferably affixed to the base plate 12 by forming a pad slot 102 through the base plate 12 having the same linear configuration as the friction pad 100. A portion of the above-described pad material is extruded through the pad slot 102 and extends slightly beyond the top 24 of the base plate 12 to form the friction pad 100. The remainder of the pad material is securely fixed in the pad slot 102 by the elastic expansion force of the pad material and may also extend beneath the pad slot 102 beyond the bottom 26 of the base plate 12.

Figure 8:
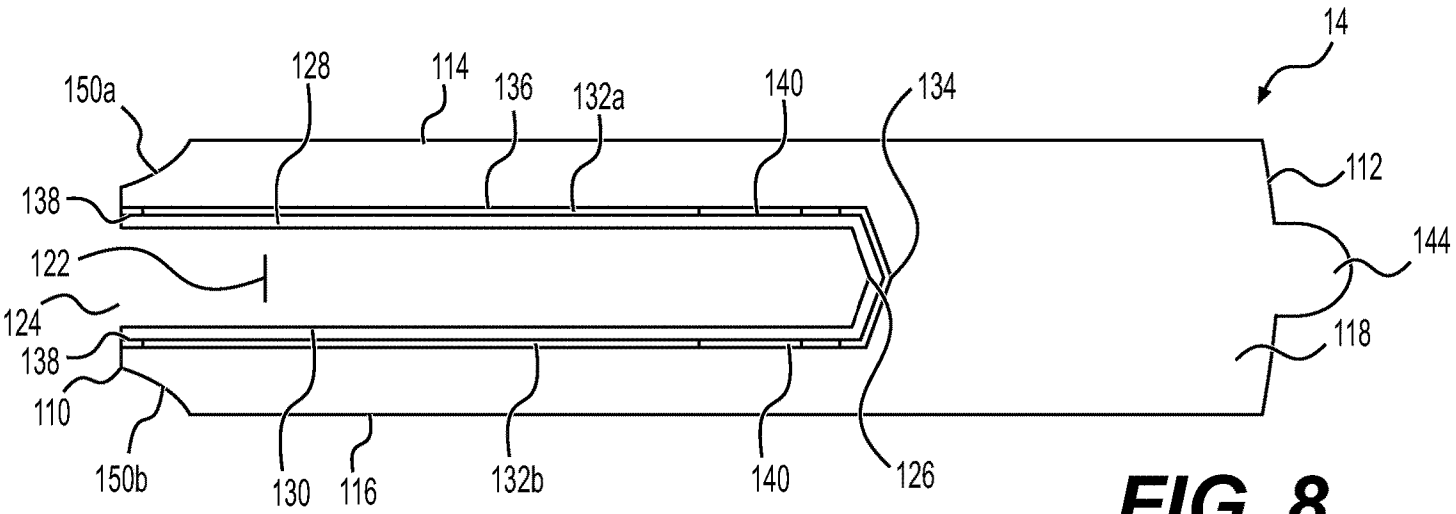
FIG. 8 is a top plan view of a calibration plate used in the golf training device when in the calibration configuration.
Figure 9:
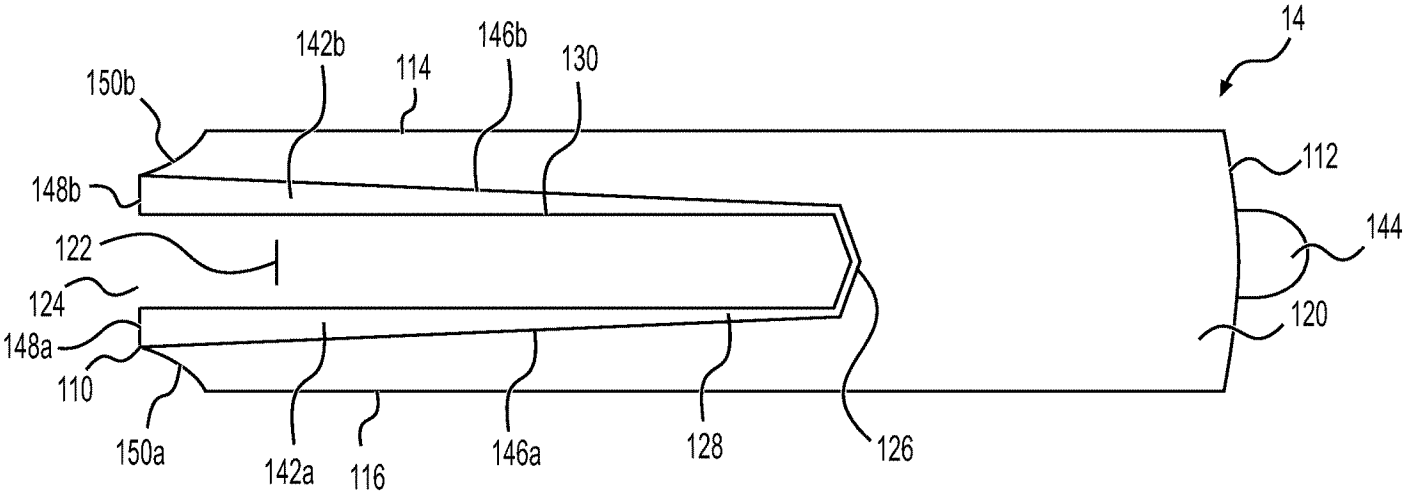
FIG. 9 is a bottom plan view of the calibration plate shown in FIG. 8.
Figure 10:
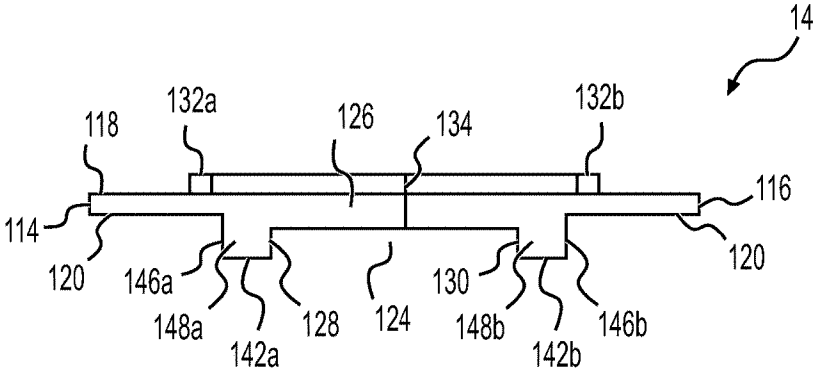
FIG. 10 is a front elevation view of the calibration plate shown in FIG. 8.

Referring to FIGS. 8-10, the present embodiment of the calibration plate 14 is a unitary structure preferably fabricated from a relatively thin, but sturdy, semi-rigid plastic. The calibration plate 14 has an elongate four-sided planar configuration similar to that of the base plate 12 with a front 110, rear 112, first lateral outer side 114, second lateral outer side 116, top 118 and bottom 120. Unlike the first and second lateral outer sides 20, 22 of the base plate 12, however, the first and second lateral outer sides 114, 116 of the calibration plate 14 are in parallel alignment with one another and with the horizontally oriented longitudinal axes of the calibration plate 14 and base plate 12, respectively. The calibration plate 14 has a length substantially the same as that of the base plate 12 and a width significantly less than that of the base plate 12, but greater than that of the putting channel 28.

The calibration plate 14 has a four-sided ball clearance opening 122 cut out of its interior that overlays the putting channel 28 and has a longitudinal axis that is collinear with the longitudinal axes of the calibration plate 14 and putting channel 28. The ball clearance opening 122 has a configuration resembling that of the putting channel 28 with an open front 124, a closed rear 126, a first lateral inner side 128 and a second lateral inner side 130. The positions of the open front 124 and closed rear 126 of the ball clearance opening 122 substantially correspond to the positions of the open front 30 and closed rear 32 of the putting channel 28, respectively. However, unlike the first and second lateral inner sides 34, 36 of the putting channel 28, the first and second lateral inner sides 128, 130 of the ball clearance opening 122 are parallelly aligned with one another. As such, the ball clearance opening 122 has a substantially U-shape configuration with a uniform width that is only slightly less than the width of the putting channel 28 at its closed rear 32 and a length that is only slightly less than the length of the putting channel 28. As such, an exemplary ball clearance opening 122 has a width slightly less than about 0.875 inches and a length slightly less than about 8.5 inches.

The calibration plate 14 has parallelly aligned first and second lateral ball guide rails 132*a*, 132*b* and a rear ball guide rail 134 integrally formed with the top 118 of the calibration plate 14 that extend vertically upward therefrom. The first and second lateral ball guide rails 132*a*, 132*b* are positioned on opposite sides of the ball clearance opening 122 from one another and are equidistant from the longitudinal axis of the ball clearance opening 122. The first lateral ball guide rail 132*a* resides between the first lateral inner side 128 of the ball clearance opening 122 and the first lateral outer side 114 of the calibration plate 14, but is more proximal to and nearly abuts the first lateral inner side 128 with only a narrow strip on the top 118 of the calibration plate 14 separating the first lateral ball guide rail 132*a* from the first lateral inner side 128. The second lateral ball guide rail 132*b* resides between the second lateral inner side 130 of the ball clearance opening 122 and the second lateral outer side 116 of the calibration plate 14, but more is proximal to and nearly abuts the second lateral inner side 130 with only a narrow strip on the top 118 of the calibration plate 14 separating the second lateral ball guide rail 132*b* from the second lateral inner side 130. The rear ball guide rail 134 resides between the closed rear 126 of the ball clearance opening 122 and the rear 112 of the calibration plate 14, but is more proximal to and nearly abuts the closed rear 126 with only a narrow strip on the top 118 of the calibration plate 14 separating the rear ball guide rail 134 from the closed rear 126.

The open front 124 of the ball clearance opening 122, the first and second lateral ball guide rails 132*a*, 132*b* and rear ball guide rail 134 in combination define the boundary of a calibration channel 136. An exemplary width of the calibration channel 136 is about 1.5 inches. The heights of the first and second lateral ball guide rails 132*a*, 132*b* and rear ball guide rail 134 above the top 118 of the calibration plate 14 are preferably constant and equal to one another along their length. An exemplary height is about 0.125 inches. Notwithstanding the above, there are preferably two pairs of small segments on each first and second lateral ball guide rail 132*a*, 132*b* that are shorter than the remainder of the first and second lateral ball guide rails 132*a*, 132*b* and rear ball guide rail 134. The first pair is at the open front 124 of the ball clearance opening 122 and has a downward arc toward the top of the calibration plate 14, thereby functioning as a ball off-ramp 138. The second pair is adjacent to the rear ball guide rail 134 and has a concave V-shape configuration, thereby functioning as a ball retention notch 140.

The calibration plate 14 additionally has first and second calibration plate retention ridges 142*a*, 142*b* integrally formed with the bottom 120 of the calibration plate 14 and a calibration plate retention tab 144 integrally formed with the rear 112 of the calibration plate 14. The first calibration plate retention ridge 142*a* extends downward from a narrow longitudinal portion of the bottom 120 of the calibration plate 14 adjacent to the first lateral side 128 of the ball clearance opening 122. The second calibration plate retention ridge 142*b* extends downward from a narrow longitudinal portion of the bottom 120 of the calibration plate 14 adjacent to the second lateral side 130 of the ball clearance opening 122. Both first and second calibration plate retention ridges 142*a*, 142*b* extend downward a distance about equal to the thickness of the base plate 12. The calibration plate retention tab 144 extends rearward from the rear 112 of the calibration plate 14 and extends downward from the bottom 120 of the calibration plate 14 a distance about equal to the thickness of the base plate 12.

Since the width of the putting channel 28 decreases from front to rear, the width of the first and second calibration plate retention ridges 142*a*, 142*b* must similarly decrease from front to rear to maintain the width of the ball clearance opening 122 constant along its entire length. This is enabled by identically configuring the first and second calibration plate retention ridges 142*a*, 142*b* in the approximate shape of right triangles. The first and second calibration plate retention ridges 142*a*, 142*b* have first and second lateral outer sides 146*a*, 146*b* that are analogous to the hypotenuses of the right triangles and first and second front sides 148*a*, 148*b* that are analogous to the shorter legs of the right triangles. The first and second calibration plate retention ridges 142*a*, 142*b* also have first and second lateral inner sides that are one and the same as the first and second lateral sides 128, 130 of the ball clearance opening 122 and are analogous to the longer legs of the right triangles.

An additional feature of the calibration plate 14 is a first calibration plate indent 150*a* and a second calibration plate indent 150*b* formed in the front 110 of the calibration plate 14. The first and second calibration plate indents 150*a*, 150*b* are positioned on opposite sides of the ball clearance opening 122 and each has an identical arcuate configuration. The presence of the first calibration plate indent 150*a* prevents the first ball gate post 46*a* from undesirably overlapping the front 110 of the calibration plate 14 on one side of the ball clearance opening 122. The presence of the second calibration plate indent 150*b* similarly prevents the second ball gate post 46*b* from undesirably overlapping the front 110 of the calibration plate 14 on the opposite side of the ball clearance opening 122.

Method of Use for the Golf Training Device

A preferred method of use for the golf training device 10 comprises performing a calibration mode of use while the golf training device 10 is in the calibration configuration and, thereafter, reconfiguring the golf training device 10 from the calibration configuration to the putting configuration and performing a putting mode of use. The calibration configuration of the golf training device 10 is effected by removably attaching the calibration plate 14 to the base plate 12 so that the calibration plate 14 overlays the first and second lateral inner sides 34, 36 of the putting channel 28 and also overlays additional portions of the top 24 of the base plate 12 adjacent to the first and second lateral inner sides 34, 36. In addition, the calibration plate 14 overlays a substantial portion of the top 24 of the base plate 12 extending from the closed rear 32 of the putting channel 28 to the rear 18 of the base plate. Furthermore, when the golf training device 10 is in the calibration configuration, the front 110 of the calibration plate 14 and correspondingly the open front 124 of the ball clearance opening 122 align with the ball gate opening 48*a* and the closed rear 126 of the ball clearance opening 122 aligns with the putter gate opening 48*c*. The calibration plate 14 is retained in engagement with the base plate 12 by manually press fitting the first and second lateral outer sides 146*a*, 146*b* of the first and second calibration plate retention ridges 142*a*, 142*b* against the first and second lateral inner sides 34, 36 of the putting channel 28, respectively, and press fitting the calibration plate retention tab 148 against the rear 112 of the calibration plate 14.

The calibration mode is initiated by placing the golf training device 10, and more particularly the bottom 26 of the base plate 12, on a desired putting surface, typically either natural or synthetic turf. As will be apparent, the base plate 12 only has the limited ancillary function of securing the position of the calibration plate 14 on the putting surface during the calibration mode. In contrast the calibration plate 14 has the primary function of putting calibration during the calibration mode of use. In any case, the user places the golf training device 10 on the putting surface so that the longitudinal axis of the calibration channel 136 aligns with a target and corresponding target line selected by the user. The target and target line are based on a user's read of the putting surface and the user's belief that if the target line is precisely followed at the outset of the putt with the appropriate putting speed, the ball will go in the hole. This alignment is termed a first calibration alignment.

With the golf training device 10 in the first calibration alignment, the user preferably sets the putter gate width to its widest available setting by positioning the segments of the lateral faces 84*c*, 84*d* of the first and second putter gate posts 46*c*, 46*d* that are aligned with the reference marking 0 opposite one another across the putter gate opening 48*c*. These segments of the lateral faces 84*c*, 84*d* do not have first and second putter gate projections 86*c*, 86*d* extending therefrom. Although the user need not be concerned with the positions of the first and second ball gate posts 46*a*, 46*b* and the corresponding ball gate width during the calibration mode of use because the calibration channel 136 prevents any putted golf ball from contacting the first or second ball gate posts 46*a*, 46*b* regardless of the ball gate width, the user, nevertheless, preferably sets the ball gate width to its widest available setting by positioning the segments of the lateral faces 84*a*, 84*b* of the first and second ball gate posts 46*a*, 46*b* that are aligned with the reference marking 0 opposite one another across the ball gate opening 48*a*.

After setting the putter and ball gate widths, the user places a standard golf ball in the ball retention notch 140 with two points on the lower half of the golf ball resting on the first and second lateral ball guide rails 132*a*, 132*b*. The ball clearance opening 122 prevents the lowermost point or any other point on the golf ball from contacting the putting surface or top 118 of the calibration plate 14 while the ball is in the calibration channel 136. The user then sets up the putt by addressing the ball while employing the first and second eye alignment markers 98*a*, 98*b* to ensure that the user has a correct putting posture. The user knows that the eyes are positioned directly over the ball when both the first and second eye alignment markers 98*a*, 98*b* are fully visible to the user. For many golfers, positioning their eyes directly over the ball results in a proper putting posture. However, some users may prefer to slightly move their eyes from a position directly over the ball to a position that is an inch or two in the direction of the user to achieve a proper putting posture. In either case, the first and second eye alignment markers 98*a*, 98*b* assist the user in achieving a proper putting posture.

Upon completing the setup stage, the user performs a putt. As the ball rolls forward in the calibration channel 136 away from the ball retention notch 140, the two points on the lower half of the ball remain in contact with the first and second lateral ball guide rails 132*a*, 132*b* while the lowermost point on the ball remains free from contact with the putting surface or top 118 of the calibration plate 14. The first and second lateral ball guide rails 132*a*, 132*b* of the calibration channel 136 force the ball to automatically follow the straight line of the correct ball start segment. If the ball goes in the hole after exiting the calibration channel 136 via the ball off-ramp 138, no further calibration is needed. However, if the ball misses the hole to either side thereof, the user notes the degree to which the ball misses the hole. The user then moves the target and target line in accordance with the degree that the ball has missed the hole, correspondingly realigns the longitudinal axis of the calibration channel 136 to a second calibration alignment and performs the putt anew. These steps are repeated as often as necessary with newly selected or the same calibration alignments until the ball successfully goes in the hole repeatedly. The objective of the calibration mode is to ensure that the golf training device is aimed at the correct target and target line that causes the ball to go in the hole when it is putted at the correct speed.

Once the calibration mode has identified an alignment for the putt that results in the ball going in the hole, the user anchors the golf training device 10 on the putting surface to prevent the golf training device 10 from moving during the putting mode of use. If the putting surface is natural turf, anchoring is effected by inserting standard golf tees into one or more of the anchoring apertures 38*a*, 38*b*, 38*c*, 38*d* and driving the tees into the underlying turf. If the putting surface is artificial, the user relies on the friction of the nubbins 76*a*, 76*b*, 76*c*, 76*d* with the underlying artificial surface to prevent the golf training device 10 from moving during use.

The user transitions the golf training device 10 from the calibration configuration to the putting configuration by detaching the calibration plate 14 from the base plate 12. This is effected by disengaging the first and second lateral outer sides 146*a*, 146*b* of the first and second lateral calibration plate retention ridges 142*a*, 142*b* from the first and second lateral inner sides 34, 36 of the putting channel 28 using manual force. The user sets the calibration plate 14 aside without disturbing the aligned position of the base plate 12. In the absence of the calibration plate 14, the base plate 12 assumes the primary function of putting training during the putting mode of use.

The user thereafter sets the ball and putter gate widths to their desired settings. In particular, the ball gate width is set by selecting a first and second ball gate limit pairing (preferably matched) that results in the desired ball gate width. The user then aligns the two ball gate limits of the selected ball gate limit pairing opposite one another across the ball gate opening 48*a* to achieve the desired ball gate width. A desired ball gate width is larger than the width of the golf ball where it aligns with the first and second ball gate heads 56*a*, 56*b*, thereby allowing the golf ball to pass through the ball gate opening 48*a* without contacting the first or second ball gate limit 90*a*, 90*b*. It is noted that a user may select a ball gate limit pairing that results in a ball gate width wider than the minimum width necessary for the ball to clear the first or second ball gate limit 90*a*, 90*c* without contact. This provides the user with a sufficient margin of error so that the ball may to still go in the hole even if the ball is not perfectly aligned with the target and target line. As the user improves his or her putting stroke, the user can re-adjust the first and second ball gate limit pairing as desired to one that results in a narrower ball gate width.

The putter gate width is similarly set by selecting a first and second putter gate limit pairing (either matched or unmatched) that results in the desired putter gate width. The user then aligns the two putter gate limits of the selected putter gate limit pairing opposite one another across the putter gate opening 48*c* to achieve the desired putter gate width. A desired putter gate width is larger than the width of the head of the user's putter, thereby allowing the head of the putter to pass through the putter gate opening 48*c* without contacting the first or second putter gate limit 90*c*, 90*d*. It is noted that a user may select a putter gate limit pairing that results in a putter gate width wider than the minimum width necessary for the putter to clear the first or second putter gate limit 90*c*, 90*d* without contact. This provides the user with a sufficient margin of error so that the ball may to still go in the hole even if the putter is not perfectly aligned at impact. As the user improves his or her putting stroke, the user can re-adjust the first and second putter gate limit pairing as desired to one that results in a narrower yet adequate putter gate width.

The user performs the putting mode by placing a standard golf ball directly on the putting surface with the lowermost point on the ball contacting the putting surface at the closed rear 32 of the putting channel 28. The user sets up the putt in substantially the same manner as described above with respect to the calibration mode. However, unlike the calibration mode where the calibration plate 14 covers the friction pad 100, the putting mode utilizes the exposed friction pad 100 to prevent the bottom of the putter head from slipping out of alignment with the ball during the setup stage of the putt. The user then performs a putt without the calibration channel 136 automatically directing the ball along a correct straight ball start segment. If the user does not squarely align the putter face with the target line, the putter head may contact one of the first or second putter gate limits 90*c*, 90*d* and fail to pass through the putter gate opening 48*c* cleanly, thereby disrupting the putt and requiring correction. If the ball does not follow a correct ball start segment of the target line while in the putting channel 28, the ball may contact one of the first or second ball gate limits 90*a*, 90*b* and fail to pass through the ball gate opening 48*a* cleanly, likewise disrupting the putt and requiring correction. The user continues performing putts without altering the alignment of the base plate 12 until the user is consistently putting the ball in the hole without disruption from the first and second putter gate limits 90*c*, 90*d* and/or first and second ball gate limits 90*a*, 90*b*. The objective of the putting mode is to give the user feedback that is used to correct flaws in the user's putting stroke and build confidence in his or her ability to perform a proper setup and putting stroke on a selected putting surface via repetitive practice.

While the forgoing preferred embodiments of the invention have been described and shown, it is understood that alternatives and modifications, such as those suggested and others, may be made thereto and fall within the scope of the invention.

What is claimed is:

1. A golf training device comprising:

a base plate having a top, a bottom, a front, a rear and a putting channel between said front and rear of said base plate, said putting channel having an open front at said front of said base plate; and a ball gate positioned on said top of said base plate proximal to said front of said base plate and said open front of said putting channel, wherein said ball gate has a first ball gate post, a second ball gate post and an adjustable ball gate width adjusted by rotating said first and/or second ball gate posts.

2. The golf training device of claim 1, wherein said putting channel further includes a first lateral inner side, a second lateral inner side and a closed rear, and wherein said putting channel extends in a narrowing taper from said open front to said closed rear of said putting channel, thereby providing said putting channel with a substantially V-shape configuration widening as said putting channel approaches said open front of said putting channel.

3. The golf training device of claim 2, wherein said open front of said putting channel is more proximal to said front of said base plate than to said rear of said base plate.

4. The golf training device of claim 2, wherein said closed rear of said putting channel is more proximal to said rear of said base plate than to said front of said base plate.

5. The golf training device of claim 2 further comprising a first eye alignment mark and a second eye alignment mark formed on said top of said base plate on opposite sides of said putting channel and adjacent to said closed rear of said putting channel and rear portions of said first and second lateral inner sides of said putting channel.

6. The golf training device of claim 1, further comprising a putter gate positioned on said top of said base plate proximal to said rear of said base plate and having an adjustable putter gate width sufficient to allow a head of a putter to pass through said putter gate, wherein said putter gate includes a first putter gate post and a second putter gate post and said putter gate width is adjusted by rotating said first and/or second putter gate posts.

7. The golf training device of claim 1 further comprising a friction pad on said top of said base plate behind said putting channel.

8. The golf training device of claim 7, wherein said friction pad has a longitudinal axis collinear with a longitudinal axis of said base plate and is formed from an elastically deformable high friction material.

9. A golf training device comprising:

a base plate having a top, a bottom, a front, a rear and a putting channel between said front and rear of said base plate, said putting channel having an open front at said front of said base plate;

a calibration plate selectively attachable to said base plate, wherein said calibration plate overlays said putting channel when said calibration plate and base plate are attached to one another, and wherein said calibration plate has a calibration channel; and a putter gate positioned on said top of said base plate proximal to said rear of said base plate and having an adjustable putter gate width sufficient to allow a head of a putter to pass through said putter gate, wherein said putter gate includes a first putter gate post and a second putter gate post and said putter gate width is adjusted by rotating said first and/or second putter gate posts.

10. The golf training device of claim 9, further comprising first and second lateral ball guide rails on said calibration plate laterally bounding said calibration channel.

11. The golf training device of claim 10, wherein said first and second lateral ball guide rails are aligned in parallel with one another.

12. The golf training device of claim 9, wherein said calibration plate has a ball clearance opening with a first lateral inner side, a second lateral inner side, an open front and a closed rear.

13. The golf training device of claim 12, further comprising first and second lateral ball guide rails on said calibration plate laterally bounding said calibration channel and extending adjacent to said first and second lateral inner sides of said ball clearance opening.

14. A golf training device comprising:

a base plate having a top, a bottom, a front, a rear and a putting channel between said front and rear of said base plate, said putting channel having an open front at said front of said base plate;

a calibration plate selectively attachable to said base plate, wherein said calibration plate overlays said putting channel when said calibration plate and said base plate are attached to one another, and wherein said calibration plate has a calibration channel with an open front; and a ball gate positioned on said top of said base plate proximal to said front of said base plate and said open front of said calibration channel, wherein said ball gate has a first ball gate post, a second ball gate post and an adjustable ball gate width adjusted by rotating said first and/or second ball gate posts.

15. The golf training device of claim 14 further comprising a putter gate positioned on said top of said base plate proximal to said rear of said base plate and having an adjustable putter gate width sufficient to allow a head of a putter to pass through said putter gate, wherein said putter gate includes a first putter gate post and a second putter gate post and said putter gate width is adjusted by rotating said first and/or second putter gate posts.

16. The golf training device of claim 14 further comprising a friction pad on said top of said base plate behind said putting channel formed from an elastically deformable high friction material.

17. The golf training device of claim 14, wherein said putting channel has a first lateral inner side, a second lateral inner side, an open front and a closed rear, and wherein said putting channel extends in a narrowing taper from said open front to said closed rear of said putting channel, thereby providing said putting channel with a substantially V-shape configuration widening as said putting channel approaches said open front of said putting channel.

18. The golf training device of claim 17 further comprising a first eye alignment mark and a second eye alignment mark formed on said top of said base plate on opposite sides of said putting channel and adjacent to said closed rear of said putting channel and rear portions of said first and second lateral inner sides of said putting channel.

19. The golf training device of claim 14, further comprising first and second lateral ball guide rails on said calibration plate laterally bounding said calibration channel.

* * * * *